US006558480B1

(12) United States Patent
Rochfort et al.

(10) Patent No.: US 6,558,480 B1
(45) Date of Patent: May 6, 2003

(54) PROCESS AND COMPOSITION FOR CONVERSION COATING WITH IMPROVED HEAT STABILITY

(75) Inventors: Gary L. Rochfort, Shelby Township, MI (US); Timm L. Kelly, Birmingham, MI (US); Richard D. Banaszak, Sterling Heights, MI (US)

(73) Assignee: Henkel Corporation, Gulp Mills, PA (US)

( * ) Notice: Subject to any disclaimer, the term of this patent is extended or adjusted under 35 U.S.C. 154(b) by 0 days.

(21) Appl. No.: 09/807,159

(22) PCT Filed: Oct. 8, 1999

(86) PCT No.: PCT/US99/21445

§ 371 (c)(1),
(2), (4) Date: Jul. 23, 2001

(87) PCT Pub. No.: WO00/20657

PCT Pub. Date: Apr. 13, 2000

Related U.S. Application Data

(60) Provisional application No. 60/103,471, filed on Oct. 8, 1998.

(51) Int. Cl.[7] ..... C23C 22/00

(52) U.S. Cl. ..... 148/247; 148/251; 148/252; 148/273; 148/274; 106/14.15; 106/14.13

(58) Field of Search ..... 148/247, 251, 148/252, 273, 274; 106/14.15, 14.13

(56) References Cited

U.S. PATENT DOCUMENTS

| | | | | |
|---|---|---|---|---|
| 3,431,182 | A | 3/1969 | Frant | 204/1 |
| 4,148,670 | A | 4/1979 | Kelly | 148/6.15 |
| 4,273,592 | A | 6/1981 | Kelly | 148/6.27 |
| 4,457,790 | A | 7/1984 | Lindert et al. | 148/6.15 R |
| 4,963,596 | A | 10/1990 | Lindert et al. | 526/313 |
| 4,978,399 | A | 12/1990 | Kodama et al. | 148/250 |
| 5,089,064 | A | 2/1992 | Reghi | 148/247 |
| 5,281,282 | A | 1/1994 | Dolan et al. | 148/247 |
| 5,356,490 | A | 10/1994 | Dolan et al. | 148/247 |
| 5,449,415 | A | 9/1995 | Dolan | 148/259 |
| 5,534,082 | A | 7/1996 | Dollman et al. | 148/247 |
| 5,769,967 | A | 6/1998 | Dolan | 148/247 |
| 5,897,716 | A | 4/1999 | Reghi et al. | 148/247 |
| 6,059,896 | A | 5/2000 | Ehara et al. | 148/247 |

OTHER PUBLICATIONS

Kirk–Othmer Encyclopedia of Chemical Technology, "Metal Surface Conversion Treatments", John Wiley & Sons, Inc., 1995.*

Henkel Surface Technologies Technical Process Bulletin No. 1580—Rev. Jan. 3, 1994—Ridoline® 123 Acidic Cleaner for D & I Aluminum Cans (7 pages).

* cited by examiner

*Primary Examiner*—John Sheehan
*Assistant Examiner*—Andrew L. Ottmans
(74) *Attorney, Agent, or Firm*—Stephen D. Harper; Mary K. Cameron

(57) ABSTRACT

A conversion coating that does not substantially diminish the luster of a metal surface on which it is coated nor impair adhesion to the surface of lacquers and printing inks commonly used on beverage containers may be provided by contacting the metal surface with an aqueous liquid composition comprising water and at least the following components: (A) a component of one or more dissolved transition metal compounds that contain zirconium and may also include titanium, provided that zirconium constitutes more than 30% of the moles of the total moles or zirconium and titanium; (B) a component of at least one dissolved compound that contains inorganically bonded fluorine and is not part of component (A); and (C) a component of dissolved organic polymer molecules.

19 Claims, No Drawings

PROCESS AND COMPOSITION FOR CONVERSION COATING WITH IMPROVED HEAT STABILITY

This application claims priority from United States Provisional application Ser. No. 60/103,471, filed Oct. 8, 1998, and International application PCT/US99/21445, filed Oct. 8, 1999.

BACKGROUND OF THE INVENTION

This invention relates to compositions and processes for forming on metals, particularly aluminum and its alloys, a conversion coating that is substantially transparent, so that aesthetically appealing characteristics of the metal surface that is conversion coated are not overly impaired by the conversion coating. (No quantitative test is in common use to measure the degree of preservation of the aesthetic qualities of the metal, but for the principal application area of this invention, aluminum beverage cans, any ordinary consumer can readily judge whether the bright reflectance of the can is as good as usual.)

The following discussion and the description of the invention will be set forth primarily for aluminum cans. However, it is to be understood that, with any obviously necessary modifications, both the discussion and the description of the invention apply also to tin plated steel cans and to other types of metal surfaces over which a transparent conversion coating is practically interesting.

Aluminum cans are commonly used as containers for a wide variety of products, particularly beverages. The exterior cylindrical surfaces of such cans normally are at least partially decorated with lacquer and/or printing ink and the interior surfaces, including the inner dome, normally are protected with sanitary lacquer, but the outer domes of the cans usually do not have lacquer or any similar coating, except possibly for a "rim coat" on its outer margin. It is considered desirable in the market for all exterior parts of the can to have a lustrous surface, even in the parts that are printed or colored, with the reflective properties that are essentially unique to polished metal surfaces. Therefore, for this particular field of use, the conversion coated surface must have adequate adhesion to printing inks and/or lacquer.

In the most widely used current commercial practice, at least for large scale operations, aluminum cans are typically subjected to a succession of six cleaning and rinsing operations as described in Table A below. It is preferable to include another stage, usually called "Prerinse", before any of the stages shown in Table A; when used, this stage is usually at ambient temperature (i.e., 20–25° C.) and is most preferably supplied with overflow from Stage 3 as shown in Table A and is next most preferably supplied with overflow from Stage 1 as shown in Table A. The prerinse may also be tap water. Any of the rinsing operations shown as numbered stages in Table A preferably includes two, or more preferably three, sub-stages, which in consecutive order of their use are usually named "drag-out", "recirculating", and "exit" or "fresh

TABLE A

| Stage Number | Action on Surface During Stage |
|---|---|
| 1 | Aqueous Acid Precleaning |
| 2 | Aqueous Acid (or Alkali) and Surfactant Cleaning |
| 3 | Tap Water Rinse |

TABLE A-continued

| Stage Number | Action on Surface During Stage |
|---|---|
| 4 | Mild Acid Postcleaning, Conversion Coating, or Tap Water Rinse |
| 5 | Tap Water Rinse |
| 6 | Deionized ("DI") Water Rinse |

water" sub-stages; if only two sub-stages are used, the name "drag-out" is omitted. Most preferably, when such sub-stages are used, a blow-off follows each sub-stage, but in practice such blow-offs are often omitted. Also, any of the stages numbered 1 and 4–6 in Table A may be omitted in certain operations.

A conversion coating over the metallic surfaces of beverage cans, prior to any lacquer coating or printing, is generally considered desirable, in order to increase the adhesion of the inner sanitary lacquer and exterior decorative and protective coatings, especially when the cans in process are to be subjected to stressful metal working operations such as necking (i.e., reducing the can diameter in its neck region) and flanging (to provide an anchoring point for a separate cap for the filled container). However, prior art conversion coatings that were sufficiently transparent to preserve the metallic luster of the surfaces coated with them were susceptible to at least one of the following disadvantageous characteristics when subjected to subsequent heating: development of exterior dome staining during pasteurization; loss of luster of the exterior dome surface upon its exposure to steam; and substantially weakened adhesion of lacquers and printing inks, compared with surfaces of otherwise identical aluminum having the same conversion coating not exposed to heat and sometimes even compared to otherwise identical aluminum that never had any conversion coating. A major object of the present invention is to provide a transparent conversion coating that will avoid or reduce at least one, or preferably all, of these disadvantageous characteristics of the prior art. Other objects will be apparent from the further description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical, or in fact a stable neutral substance with well defined molecules; the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.; and the first definition of an acronym or other abbreviation applies to all subsequent uses of the same acronym or other abbreviation.

BRIEF SUMMARY OF THE INVENTION

In accordance with this invention, it has been found that the major object as stated above is achievable with an aqueous conversion coating composition that comprises, preferably consists essentially of, or more preferably consists of, water and the following components:

(A) a component of one or more dissolved transition metal compounds that contains zirconium, hafnium, or both (hereinafter, for brevity, only zirconium will be mentioned, but it is to be understood that zirconium may be partially or totally replaced by hafnium) and may also include titanium, provided that zirconium constitutes at least 30% of the moles of the total moles of zirconium and titanium;

(B) a component of at least one dissolved compound that contains inorganically bonded fluorine and is not part of component (A); and (C) a component of dissolved organic polymer molecules; and, optionally, one or more of the following components:

(D) a component of dissolved chelating agent molecules that are not part of any of immediately previously recited components (A) through (C);

(E) a component of dissolved acid molecules that are not part of any of immediately previously recited components (A) through (D);

(F) a component of preservative molecules that are not part of any of immediately previously recited components (A) through (E); and (G) a component of dissolved cations from the metal surface being or to be conversion coated.

Various embodiments of the invention include a liquid working composition that will form a conversion coating upon contact with a suitable metal substrate for a sufficient period of time; a concentrate composition that when mixed with water, and optionally with other materials, will form a liquid working composition, a process including forming a substantially transparent conversion coating on a metal surface by contacting the metal surface with such a working composition, and a metal article having a conversion coating formed according to the invention on at least part of its surface.

DETAILED DESCRIPTION OF THE INVENTION

Phosphate is one of the most common ingredients of conversion coatings in general. However, a working composition according to this invention preferably does not contain more than, with increasing preference in the order given, 1.0, 0.5, 0.3, 0.10, 0.050, 0.020, 0.0100, 0.0050, 0.0020, 0.0010, 0.00050, 0.00020, or 0.00010 percent of phosphorus atoms contained within any dissolved oxyacids of phosphorus, or any partially or completely neutralized salts of such acids, that are dissolved in the composition, because it has been found that, if the concentration of phosphorus containing inorganic anions in a working composition according to the invention is too high, a hazy white stain usually develops on a beverage container treated with the working composition and later exposed to steam.

The zirconium that is required for component (A) and the titanium that is permitted as part of component (A) may be supplied by any water soluble compound of these two metals, which may be dissolved in either cationic or anionic form. At least for economy, because it reduces the amount of component (B) that is needed, hexafluorozirconic acid and its salts are the preferred sources of zirconium and hexfluorotitanic acid and its salts are the preferred source of titanium, with the acids independently most preferred in both instances. In a working composition according to the invention, the total concentration of dissolved zirconium and titanium atoms preferably is at least, with increasing preference in the order given, 0.25, 0.30, 0.35, 0.40, 0.45, 0.50, 0.55, 0.60, 0.65, 0.70, 0.75, 0.80, 0.85, or 0.88 millimoles per liter of working composition, a unit of concentration that may be freely applied hereinafter to other constituents as well as to zirconium and titanium and is hereinafter usually abbreviated as "mM/l". Of this total, more than 30 mole % must be zirconium, and preferably, with increasing preference in the order given, at least 35, 40, 45, or 50 mole percent is zirconium. There is no technical disadvantage if the only transition metal atoms in component (A) are zirconium.

Considerably larger concentrations of zirconium and, optionally, titanium may be used without significant technical disadvantage. For example, more than 4 mM/l of hexafluorozirconic acid may be used without substantial deterioration in performance of the conversion treated containers in any of the tests described in the examples. However, there is somewhat increased danger of separation of the working composition into two phases and there is no improvement in performance. Therefore, at least for economy, the total concentration of zirconium and titanium in a working composition according to the invention preferably is not more than, with increasing preference in the order given, 3.5, 3.0, 2.5, 2.0, 1.8, 1.6, 1.4, 1.2, or 1.0 mM/l.

Irrespective of the source(s) of zirconium and, optionally, titanium, a working composition according to the invention preferably contains more than enough dissolved fluorine atoms in anionic form to form $ZrF_6^{-2}$ anions with all of the zirconium dissolved in the working composition and $TiF_6^{-2}$ anions with any titanium present. For this reason, as already noted, supplying these metals in the form of salts or acids that contain these anions is normally preferred. However, solutions that contain hexafluorozirconate with no additional fluoride are susceptible to precipitation of the zirconium as basic salts. Therefore, the molar ratio of fluorine to the total of zirconium and titanium in a working composition according to the invention preferably is at least, with increasing preference in the order given, 6.05:1.00, 6.10:1.00, 6.15:1.00, 6.20:1.00, or 6.25:1.00. Component (B) preferably therefore contains at least a sufficient amount of soluble anionic fluoride to achieve at least one of these ratios in the working composition, when considered together with any fluorine present in component (A). Sufficient hydrofluoric acid to achieve one of these ratios is often added by commercial suppliers of hexafluorozirconic and hexafluorotitanic acids. If these materials are used as the sources for component (A), it may not be necessary to include any additional source for component (B). If such an additional source is needed, hydrofluoric and/or tetrafluoroboric acids are preferred, as considered further below.

Soluble anionic fluorine has at least two other important effects in a working composition according to the invention: It promotes the dissolution of aluminum atoms, which at least at the instant of dissolution are believed to be trivalent cations, from the surface to be conversion coated, and, to the extent stoichiometrically and thermodynamically possible, it forms coordinate complexes with the aluminum so dissolved or any other aluminum cations introduced into the solution. Only fluoride ions that are not already bound into complex ions and/or exist in equilibrium from dissociation of complex ions are effective in promoting dissolution of aluminum cations and complexing them. The effective concentration of this kind of fluoride, called "free fluoride" herein and "available fluoride" in U.S. Pat. No. 4,273,592, is defined and can conveniently be measured by means of a fluoride sensitive electrode as described in U.S. Pat. No. 3,431,182 and commercially available from Orion Instruments. "Free fluoride" as this term is used herein was measured relative to "Standard Solution 120 MC" commercially available from the Henkel Surface Technologies ("HST") Division of Henkel Corporation, Madison Heights, Mich. by a procedure described in detail in HST Technical Process Bulletin No. 1580. The Orion Fluoride Ion Electrode and the reference electrode provided with the Orion instrument are both immersed in the noted Standard Solution and the millivolt meter reading is adjusted to 0 with a digital keypad on the instrument, after waiting if necessary for any initial drift in readings to dissipate. The electrodes are then rinsed with deionized or distilled water, dried, and immersed in the sample to be measured, which should be brought to the same temperature as the noted Standard Solution had when it was used to set the meter reading to 0. The reading of the electrodes immersed in the sample is taken directly from a millivolt (hereinafter usually abbreviated as "mv") meter on the instrument.

Free fluoride is preferably supplied to a working composition according to the invention as HF or soluble neutral or acid salts thereof, and the amount of it preferably is such as to give an electrical potential of a fluoride sensitive electrode in contact with the working composition that is at least, with increasing preference in the order given, −200, −170, −150, −140, −130, −120, −110, −105, −100, −95, or −91 mv, compare with the potential of the same fluoride sensitive electrode in contact with the Standard Solution noted above, and independently preferably is not more than, with increasing preference in the order given, 100, 70, 40, 10, 0, −10, −20, −30, −40, −50, −60, −70, −75, −80, −85, or −89 mv. If the working composition has a potential of less than −200 mv, the aluminum surface being conversion coated will usually be etched too rapidly to retain a lustrous appearance as desired and may even fail to form any of the desired conversion coating, while if the working composition has a potential of more than 100 mv, the rate of formation of the conversion coating usually will be impractically slow, and the working composition is likely to form precipitates on standing. Free fluoride thus constitutes at least part of component (B) of a composition according to the invention.

Although the amount of free fluoride must be limited for the reasons given above, a "reservoir" of fluoride is advantageously present in a working composition according to the invention, so that the concentration of dissolved aluminum cations in the bulk of the working composition, as contrasted to the immediate vicinity of the surface being conversion coated, can not become so large as to cause difficulties in the conversion coating process. Such a reservoir of fluoride is conveniently and preferably provided by including in a working composition according to the invention, as part of its component (B), complex anions including fluorine that have a higher dissociation equilibrium constant than hexafluorozirconate but not so high as to contribute an excessive amount of free fluoride. Tetrafluoroboric acid and its salts are preferred for this purpose, the acid being more preferable at least for economy. Irrespective of the source, 20 a working composition according to the invention preferably includes dissolved tetrafluoroborate in a concentration that is stoichiometrically equivalent to a concentration of tetrafluoroboric acid that is at least, with increasing preference in the order given, 0.005, 0.010, 0.020, 0.030, 0.035, 0.040, 0.045, 0.047, 0.049, or 0.051 parts by weight per thousand parts of total composition, this concentration unit being hereinafter usually abbreviated as "ppt", and independently preferably is not more than, with increasing preference in the order given, 0.5, 0.30, 0.20, 0.15, 0.10, 0.080, 0.075, 0.070, 0.065, 0.060, or 0.055 ppt. Fully satisfactory results can be obtained from freshly made working compositions that do not include any such free fluoride reservoir, but the presence of such a reservoir promotes performance stability after substantial amounts of aluminum have been dissolved into the working composition by prolonged use.

In addition to providing a reservoir of fluoride that can become free as free fluoride originally in the composition is consumed, tetrafluoroborate is believed to have a preservative effect because of its boron content. This can be advantageous to the storage stability of compositions according to the invention, because some of the organic ingredients in these compositions are capable of nourishing microorganisms that may enter them from various ambient environments.

Component (C) as described above is preferably selected from the group of water soluble polymers that contain, in each molecule, at least one of two types of polar moieties: (1) acidic moieties such as carboxylate, phosphonate, sulfate, and the like, which are independently preferably neutralized with a strong alkali, in order to maximize the degree of localization of electrically negative charges in the vicinity of these acidic moieties within the polymers that contain them, when these polymers are dissolved in the at least mildly acidic preferred compositions according to the invention; and (2) nucleophilic moieties such as amino nitrogen, phosphino phosphorus, and the like that form localized positive charge centers, when dissolved in preferred compositions according to the invention, by attracting protons to themselves to form cationic moieties. More particularly, component (C) as described above preferably contains at least one of:

- a sufficient number of acidic moieties that the number ratio of acid moieties to total carbon atoms within component (C) is at least, with increasing preference in the order given, 1.0:9.0, 1.0:8.0, 1.0:7.0, 1.0:6.0, 1.0:5.0, 1.0:4.0, 1.0:3.0, or 1.0:2.0; and
- a sufficient number of nucleophilic moieties that the number ratio of nucleophilic moieties to total carbon atoms within component (C) is at least, with increasing preference in the order given, 1.0:50, 1.0:40, 1.0:30, 1.0:27, 1.0:24, 1.0:22, 1.0:20, 1.0:18, or 1.0:16.

In a first particularly preferred embodiment of the invention, component (C) comprises polymers that contain, as at least 10% of their total mass, one or more aminomethylphenyl moieties, each of which conforms to the following general formula:

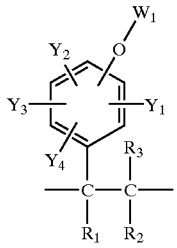

wherein:

each of $R^1$ through $R^3$ is selected, independently of each other and independently from one aminomethylphenyl moiety of the component to another, from the group consisting of a hydrogen moiety, an alkyl moiety with from 1 to 5 carbon atoms, and an aryl moiety with from 6 to 18 carbon atoms;

each of $Y^1$ through $Y^3$ is selected, independently of each other and independently from one aminomethylphenyl moiety to another, from the group consisting of: a hydrogen moiety; a —$CH_2Cl$ moiety; an alkyl moiety with from 1 to 18 carbon atoms; an aryl moiety with from 6 to 18 carbon atoms; a moiety conforming to the general formula —$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

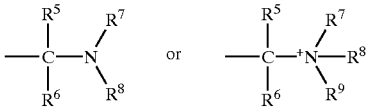

wherein:

each of $R^5$ through $R^7$ is selected, independently of each other and independently from one aminomethylphenyl moiety to another, from the group consisting of a hydrogen moiety, an alkyl moiety, an aryl moiety, a hydroxyalkyl moiety, an aminoalkyl moiety, a mercaptoalkyl moiety, and a phosphoalkyl moiety; $R^8$ is a polyhydroxy alkyl moiety and $R^9$ is selected from the group consisting of a hydrogen moiety, an alkyl moiety, an aryl moiety, a hydroxy or polyhydroxy alkyl moiety, an amino or polyamino alkyl moiety, a mercapto or polymercapto alkyl moiety, a phospho or polyphospho alkyl moiety, an —$O^-$ moiety, and an —OH moiety;

$Y^4$ is a moiety Z as above defined; and $W^1$ is selected, independently from one molecule of the component to another and from one to another aminomethylphenyl moiety, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, or unsubstituted alkylbenzyl moiety; a halo or polyhalo alkyl, or halo or polyhalo alkenyl, moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety.

When component (C) is selected so as to correspond to this first particularly preferred embodiment:

its molecules preferably have a weight average molecular weight that is at least, with increasing preference in the order given, 360, 700, 1500, 3000, 6000, or 10,000 daltons and independently preferably is not more than, with increasing preference in the order given, 2,000,000, 1,000,000, 500,000, 250,000, 125,000, 70,000, or 30,000 daltons; and, independently, the concentration of component (C) in a working composition according to the invention preferably is at least, with increasing preference in the order given, 0.009, 0.018, 0.030, 0.045, 0.060, 0.075, or 0.085 grams per liter (hereinafter usually abbreviated as "g/l") and independently preferably is not more than, with increasing preference in the order given, 0.36, 0.30, 0.24, 0.21, 0.18, 0.15, or 0.12 g/l.

Still more preferably within this first particularly preferred embodiment, component (C) is selected from molecules that include, as at least, with increasing preference in the order given, 10, 20, 30, 40, 50, 60, 70, 80, or 90% of their total mass, aminomethylphenyl moieties that conform to the general formulas for such moieties given above when, independently for each part of the general formulas stated: each of $R^1$ through $R^3$, $R^5$, $R^6$, $Y^1$ through $Y^3$, and $W^1$ is a hydrogen moiety; $R^7$ is an alkyl moiety or a hydrogen moiety, preferably an alkyl moiety having not more than, with increasing preference in the order given, 5, 4, 3, 2, or 1 carbon atoms; $R^8$ is a moiety conforming to the general formula —$CH_2(CHOH)_p$—H, where p is an integer that is at least, with increasing preference in the order given, 2, 3, 4, or 5 and independently preferably is not more than, with increasing preference in the order given, 12, 10, 8, 7, or 6; and $R^9$ is not present (or, in other words, Z conforms to the left rather than to the right one of its two alternative general formulas as above shown).

In a second particularly preferred embodiment, component (C) is selected from polymers of at least one of maleic, acrylic, and methacrylic acids. For this second particularly preferred embodiment:

the concentration of component (C) in a working composition according to the invention preferably is at least, with increasing preference in the order given, 0.009, 0.015, 0.030, 0.035, 0.040, 0.045, 0.050, 0.055, 0.060, or 0.064 g/l and independently preferably is not more than 1.0, 0.8, 0.6, 0.40, 0.30, 0.20, 0.15, or 0.10 g/l, these maximum preferences being primarily for economy; and, independently, the molecular weight of the polymer preferably is at least, with increasing preference in the order given, 200, 300, 400, 500, 600, 700, 800, 900, or 1000 and independently preferably is not more than, with increasing preference in the order given, $10^7$, $10^6$, $10^5$, $8\times10^4$, $6\times10^4$, $4\times10^4$, $2\times10^4$, or $1.0\times10^4$.

Although not necessary, the presence of optional component (D) of chelating agents in a composition according to the invention is usually preferred, at least when the composition contains amounts of dissolved calcium and/or magnesium ions that are characteristic of hard domestic and industrial water supplies. Any chelating agent present is preferably selected from the group consisting of molecules each of which contains at least two nucleophilic moieties selected from the group consisting of carboxyl, carboxylate, non-carboxyl hydroxyl, amino, thio, phosphonic acid, phosphonate, phosphinic acid, and phosphinate moieties, with these at least two moieties being bonded into the molecule in positions such that a five- or six-membered ring of atoms can be formed by atoms in the molecule and a multivalent metal atom that is coordinatively covalently bonded to a nucleophilic atom (oxygen, nitrogen, sulfur, or phosphinic phosphorus) in each of said nucleophilic moieties in the molecule. More preferably, any chelating agent is selected from the group consisting of gluconic, citric, tartaric, and malic acids, and water soluble salts of all of these acids, or still more preferably from gluconic acid and its salts. Independently of its specific chemical nature, the concentration of chelating agents in a working composition according to the invention preferably is at least, with increasing preference in the order given, 0.020, 0.040, 0.060, 0.080, 0.10, 0.12, 0.14, or 0.16 mM/l, and independently at least for economy, preferably is not more than, with increasing preference in the order given, 2, 1.0, 0.8, 0.60, 0.50, 0.40, 0.35, 0.30, 0.25, or 0.20 mM/l.

A working composition according to the invention preferably has a pH value that is at least, with increasing preference in the order given, 1.0, 1.5, 2.0, 2.5, 2.7, 2.9, or 3.1 and independently preferably is not more than, with increasing preference in the order given, 5.0, 4.5, 4.3, 4.1, 3.9, 3.7, 3.5, or 3.3. When other ingredients of a composition according to the invention are near their most preferred values, achieving this pH value will normally require an acid that does not contain fluorine, and in such instances, nitric acid is preferred, although other acids such as sulfuric that do not contain phosphorus may alternatively be used as optional component (E). If an initial concentration of aluminum is desired as considered further below, aluminum salts of one of these acids may conveniently be used to provide both constituents.

A preservative agent, optional component (F), may be needed in some environments to protect against growth of microorganisms in a stored composition according to the invention. Numerous suitable preservatives are known to those skilled in the art and may be utilized in such instances.

As already noted, a working composition according to the invention will dissolve some aluminum from a surface that it is conversion coating. If the working composition contains essentially no dissolved aluminum at the beginning of its use, some of the dissolved aluminum will not be incorporated into the conversion coating, but instead will accumulate in the solution to constitute optional component (G). Because of this, it is often preferred to add optional component (G) at the beginning, in order to reduce the possibility of excessive etching of the aluminum surface being conversion coated with a freshly made, aluminum-free working composition. If this is desired, water soluble aluminum salt(s) of strong, phosphorus-free acids are most preferably used for the purpose. Unless fresh working composition is supplied at a high rate that is usually not economically justifiable, component (G) will eventually accumulate to a steady state value that is usually at least 0.1 g/l, and may be as high as 0.75 g/l, of dissolved aluminum. Provided that the concentration of free fluoride is kept within the preferred range given above, this amount of component (G) has no harmful effect on the conversion coating process.

In a make-up concentrate composition according to the invention, the concentrations of the various components identified above preferably are considerably higher than those preferred for working compositions. More specifically, in a make-up concentrate according to the invention, independently for each component stated, the concentration of each of those of components (A) through (G) that are present in the make-up concentrate preferably corresponds to at least, with increasing preference in the order given, 10, 30, 50, 70, 90, 100, 150, 200, 300, 400, or 500 times the preferred values specified above for the same component in a working composition. Greater concentrations in the make-up concentrate are more economical, because of the reduced cost of shipping water that can readily be added at the point of use, but lower concentrations are less susceptible to phase separations during storage. Although sometimes such phase separations are harmless if the entire concentrate is thoroughly mixed before being used, separations certainly increase the risk of not obtaining the intended concentrations of every ingredient when preparing a working composition from the concentrate. The pH and free fluoride values do not scale linearly with concentration as do the concentrations of ingredients such as zirconium and polymer, so that the preferred values for concentrates for these characteristics are those that will give the preferred pH and free fluoride values when diluted so as to provide the concentrations preferred for zirconium and polymer.

In a process according to the invention, the temperature of a working composition as described above preferably is maintained during its contact with the metal surface to be conversion coated at a temperature that is at least, with increasing preference in the order given, 30, 32, 34, 36, 38, 40, 42, 44, 46, or 48° C. and independently, primarily for economy, preferably is not more than, with increasing preference in the order given, 75, 65, 60, 58, 56, 54, 52, or 50° C. At least one temperature within this range will normally achieve formation of an effective conversion coating within a contact time of from 2 to 50 seconds, as required by most existing commercial container manufacturing and decorating plants at their current and/or projected line speeds.

The invention may be further appreciated by consideration of the following examples and comparison examples.

TEST METHODS

Retort Test: The cans were exposed to steam at 1 atmosphere pressure for 30 minutes. Their appearance was then rated on the following scale:

| | |
|---|---|
| 5 = | Best, with no haziness or patterning. |
| 4 = | Slight haze, may or may not be uniform over surface. |
| 3 = | Light cloudiness, may or may not be uniform over surface. |
| 2 = | Light cloudiness with an obvious veined pattern |
| 1 = | Worst, very cloudy over the entire surface. |

Ratings 5 and 4 are fully acceptable, but ratings of 3, 2, and 1 are usually unacceptable.

Dome Staining: The domes were removed from the cans to be tested. They were immersed in a solution which consisted of 0.2 gram per liter of sodium tetraborate decahydrate and 0.1 gram per liter of potassium chloride in deionized water. The pH of this solution was adjusted to 9.2 using either sodium hydroxide or hydrochloric acid. It was heated to 66° C. The can domes were immersed in the hot solution for 30 minutes. (Each batch of this solution was used for only one test.) The can domes were then removed, rinsed with deionized water and dried. The following scale was used to report the dome staining performance of the domes: 4=normally best, silvery with no discoloration to 1=complete dark discoloration, equivalent to the performance of a can without a conversion coating. (Cans with exceptionally bright domes may rate higher than 4, but no rating lower than 4 is usually commercially acceptable.)

Muffle Test: For this test, a treated surface is exposed to air at 538° C. for 5 minutes, and the color is observed. Lack of color traditionally indicates a coating that is thinner than is desirable. (The muffle test was originally developed as a means of visually confirming the existence of an initially transparent coating. The original transparent conversion coatings in the art contained phosphorus, which is believed to interact with small percentages of magnesium in the aluminum alloys generally used for beverage containers to produce the colors. This test is nota direct measure of any quality of the corrosion coating that has practical importance, except to assure that a coating was actually formed.)

Adhesion Testing: The cans were decorated, necked and flanged to "202" diameter on a commercial processing line, and then immersed in a solution consisting of 0.67% by volume of liquid Dawn™ Free™ detergent (concentrated version, available in retail stores) from Proctor and Gamble in deionized water for 30 minutes at 82° C. The cans were removed from the test solution, rinsed with deionized water and dried with a paper towel before testing. Scotch® Brand No. 610 adhesive tape was applied to the dry neck and flange area, burnished and forced, with a fingernail, into the small radius of curvature between the neck and the flange, and then vigorously removed in a smooth motion.

SPECIFIC EXAMPLES

Examples and Comparison Examples Group 1

In this group phosphate containing and phosphate free conversion coating liquids are compared, as are various extents of etching during cleaning of the aluminum surfaces prior to their being coated and the presence or absence of a polymer component (C) as described above for examples according to the invention. The six stages of treatment noted in Table A were all used, with spraying contact between the treatment compositions and conventional aluminum beverage cans as the substrates being treated, on a constant linear speed pilot scale belt washer. (Extensive experience has established that can conversion coating properties obtained with this apparatus are reasonably well correlated with those obtained in commercial scale can processing lines.) The tap water used was from the municipal supply of Madison Heights, Mich., and other details were as follows:

Stage 1: An aqueous solution, in tap water, of sufficient sulfuric acid to result in a pH value of 2.0 was used as the treatment composition at 54° C. with a spraying pressure of 1.4 bars.

Stage 2: RIDOLINE® 123 cleaning solution concentrate, a commercial product available from HST, was used according to the manufacturer's directions to prepare a treatment solution in tap water that also contained 24 g/l of aluminum sulfate heptadecahydrate and had variable values for Free Acid (hereinafter usually abbreviated as "FA") points and free fluoride content. These values are shown in a table below. The treatment composition for this stage was maintained at 60° C. and was sprayed at 1.4 bars spray pressure.

Stage 3: Rinse with tap water at ambient temperature of 20±10° C.

Stage 4: This was a conversion coating step. Some treatment composition details are given in Tables 1.1 and 1.2. The compositions were sprayed onto the cans for 20 sec at 48° C. at 0.3 bar spray pressure.

TABLE 1.1

COMPARISON EXAMPLE CONVERSION COATING COMPOSITION CONCENTRATES

| Ingredient | Parts of Ingredient per Thousand Parts of Composition for: Con. 1 | Con. 2 | Con. 3 | Con. 4 | Con. 5 |
|---|---|---|---|---|---|
| 45% $H_2ZrF_6$* | 44 | 82 | 0 | 76 | 102 |
| 28% $NH_3$ | 14 | 0 | 0 | 0 | 0 |
| 49% HF | 19 | 1.4 | 229 | 13 | 2.2 |
| 69.3% $HNO_3$ | 30 | 66 | 0 | 28 | 116 |
| 48% $HBF_4$ | 1.3 | 0 | 16 | 0 | 27 |
| $H_3BO_3$ | 0 | 0 | 0 | 0.1 | 0 |
| 75% $H_3PO$ | 12 | 7.6 | 0 | 15.1 | 0 |
| Na gluconate | 0.4 | 7.6 | 0 | 0.3 | 9.5 |
| 30% $H_2O_2$ | 0 | 0 | 0 | 96 | 0 |
| RHODAMINE ™ B90 | 0 | 0 | 0.04 | 0 | 0 |

Abbreviation, Footnote, and Other Notes for Table 1.1
"Con." means "Concentrate Composition".
*This ingredient also contained 0.5% of HF.
Any otherwise unstated balance of an individual ingredient was water, and the otherwise unstated balance of the composition as a whole was tap water.
RHODAMINE ™ B90 is a red dye that was added only as a warning to personnel handling the product that it contains hydrofluoric acid.

Stage 5: Rinse with tap water at ambient temperature.

Stage 6: Rinse with deionized water at ambient temperature. Dry at 150° C. for 5 minutes.

Additional composition details and test results are shown in Table 1.2. These results show that the presence of Zr and polymer and the absence of phosphate produces the best results for dome and retort stain and an acceptable result in the muffle test. Also, the reflectivity obtained with this composition containing Zr and free from phosphate is fully acceptable, although (barely) measurably lower than with Concentrate Composition #1.

TABLE 1.2

| Cleaner Comp. Values | | Conversion Comp. Characteristics | | | Test Results | | |
|---|---|---|---|---|---|---|---|
| FA Pts. | FF mv | % of Con. # | pH | FF mv | Dome Stain | Retort Stain | Muffle |
| 8 | −15 | 0.50 of #1 | 2.8 | −85 | 4 | 1 | brown |
| 16 | −15 | 0.50 of #1 | 2.8 | −85 | 3 | 1 | brown |

TABLE 1.2-continued

| Cleaner Comp. Values | | Conversion Comp. Characteristics | | | Test Results | | |
|---|---|---|---|---|---|---|---|
| | | | | | Dome | Retort | |
| FA Pts. | FF mv | % of Con. # | pH | FF mv | Stain | Stain | Muffle |
| 12 | 0 | 0.50 of #1 | 2.8 | −85 | 4 | 2 | brown |
| 8 | 15 | 0.50 of #1 | 2.8 | −85 | 4 | 1 | brown |
| 16 | 15 | 0.50 of #1 | 2.8 | −85 | 4 | 1 | brown |
| 8 | −15 | 0.65 of #2 | 2.4 | −75 | 4 | 3 | dark gold |
| 16 | −15 | 0.65 of #2 | 2.4 | −75 | 3 | 1 | brown |
| 12 | 0 | 0.65 of #2 | 2.4 | −75 | 4 | 3 | dark gold |
| 8 | 15 | 0.65 of #2 | 2.4 | −75 | 4 | 3 | dark gold |
| 16 | 15 | 0.65 of #2 | 2.4 | −75 | 4 | 3 | brown |
| 8 | −15 | 0.50 of #4 | 2.5 | −55 | 3 | 1 | light gold |
| 16 | −15 | 0.50 of #4 | 2.5 | −55 | 3 | 1 | light gold |
| 12 | 0 | 0.50 of #4 | 2.5 | −55 | 3 | 1 | light gold |
| 8 | 15 | 0.50 of #4 | 2.5 | −55 | 4 | 5 | medium gold |
| 16 | 15 | 0.50 of #4 | 2.5 | −55 | 4 | 1 | tan |
| 8 | −15 | none | n.a. | n.a. | 1 | 3 | silvery |
| 16 | −15 | none | n.a. | n.a. | 1 | 2 | silvery |
| 12 | 0 | none | n.a. | n.a. | I | 2 | silvery |
| 8 | 15 | none | n.a. | n.a. | 1 | 2 | silvery |
| 16 | 15 | none | n.a. | n.a. | 1 | 2 | silvery |
| 8 | −15 | 0.4 of #5* | 3.2 | −90 | 4 | 4 | silvery |
| 16 | −15 | 0.4 of #5* | 3.2 | −90 | 4 | 4 | silvery |
| 12 | 0 | 0.4 of #5* | 3.2 | −90 | 4 | 4 | silvery |
| 8 | 15 | 0.4 of #5* | 3.2 | −90 | 4 | 5 | silvery |
| 16 | 15 | 0.4 of #5* | 3.2 | −90 | 4 | 5 | silvery |

Footnote, New Abbreviations, and Other Notes for Table 1.2

*Compositions marked with this character also contained 0.3 g/l of a polymer substantially like that obtained from practicing the teaching of column 11 lines 39–52 of U.S. Pat. No. 4,963,596, except that the amount of formaldehyde specified there was increased by about 10%. Only the lines in the table where this character appears describe examples according to the invention; the other lines are comparison examples.

"Comp." means "Composition"; "Pts." means "Points"; "FF" means "Free Fluoride"; "Orig. Reflect." means "Original Reflectivity": "#" means "number"; "n.a." means "not applicable". The Concentrate Composition numbers are the same as in Table 1.1, and the percentage values of these concentrates in the working compositions that produced the results in this table are volume rather than mass percents.

Example and Comparison Example Group 2

In this group, amounts of component (C) as defined above were varied, as were the pH and water hardness. Only Concentrate Composition #5 from Table 1.1 was used, at a level of 0.4% by volume in the working compositions. All of the working compositions were adjusted if necessary to a free fluoride reading of −90 mv. The Retort Stain and Reflectivity tests were not used. All conversion coating forming composition properties were the same as in Group 1, unless noted to the contrary in Table 2 below, which gives details of the tests. The process conditions were as follows:

Stage 1: An aqueous solution, in tap water, of sufficient sulfuric acid to result in a pH value of 2.0 was used as the treatment composition at 54° C. with a spraying pressure of 2.0 bars and a spraying time of 27 sec.

Stage 2: RIDOLINE® 123 cleaning solution concentrate, a commercial product available from HST, was used according to the manufacturer's directions to prepare a treatment solution in tap water that also contained 24 g/l of aluminum sulfate heptadecahydrate and had 10 Free Acid (hereinafter usually abbreviated as "FA") points and 30 Total Acid points. The treatment composition for this stage was maintained at 60° C. and was sprayed at 2.0 bars spray pressure for 53 sec.

Stage 3.1: Spray rinse with tap water at ambient temperature of 20±10° C. with a spraying pressure of 0.7 bars for 15 sec.

Stage 3.2: Spray rinse with tap water at ambient temperature of 20±10° C. with a spraying pressure of 0.7 bars for 5 sec.

Stage 4: This was a conversion coating step. Some treatment composition details are given in Table 2. The compositions were sprayed onto the cans for 20 sec at 48° C. at 0.5 bar spray pressure.

Stage 5.1: Spray rinse with tap water at ambient temperature for 15 sec at a spray pressure of 0.7 bar.

Stage 5.2: Spray rinse with tap water at ambient temperature for 5 sec at a spray pressure of 0.7 bar.

TABLE 2

| Water | Coating Composition Properties | | Dome Stain | Muffle Test |
|---|---|---|---|---|
| Hardness | pH | g/l of Polymer (C) | Rating | Result |
| MH | 3.2 | 0 | 4 | Silvery gold |
| MH | 3.2 | 0.086 | 4 | Uniform light gold |
| MH | 3.2 | 0.173 | 4 | Uniform light gold |
| MH | 3.4 | 0 | 4 | Silvery gold |
| MH | 3.4 | 0.086 | 4 | Uniform light gold |
| MH | 3.4 | 0.173 | 4 | Uniform light gold |
| MH | 4.0 | 0 | 3 | Silvery gold |
| MH | 4.0 | 0.086 | 2 | Uniform light gold |
| MH | 4.0 | 0.173 | 2 | Uniform light gold |
| SH | 3.2 | 0 | 3 | Silvery gold |
| SH | 3.2 | 0.086 | 4 | Uniform light gold |
| SH | 3.2 | 0.086 | 4 | Uniform light gold |

New Abbreviations and Other Notes for Table 2

TABLE 2-continued

| Water | Coating Composition Properties | | Dome Stain | Muffle Test |
|---|---|---|---|---|
| Hardness | pH | g/l of Polymer (C) | Rating | Result |

"MH" means "Madison Heights, Michigan municipal water"; "SH" means "simulated hard water", which was made by dissolving 2.3 g/l of $MgSO_4.7H_2O$, 0.78 g/l of $NaHCO_3$, and 7.0 g/l of $CaCl_2.2H_2O$ in deionized water. "Polymer (C)" was the same polymer as was used in the polymer-containing compositions in Group 1, and only lines in this table that indicate the presenceof polymer describe examples according to the invention; the other lines describe comparison examples.

Stage 6.1: Rinse with deionized water at ambient temperature for 15 sec at a spray pressure of 0.7 bar.

Stage 6.2: Rinse with deionized water at ambient temperature for 5 sec at a spray pressure of 0.7 bar.

Dry in an oven at 150° C. for 5 minutes.

Example and Comparison Example Group 3

The polymer used and the processing conditions were the same as for Group 2, except that the compositions used in Stage 4 had the characteristics shown in Table 3, in addition to a pH value of 3.2 and free fluoride corresponding to a reading of −90 mv. These values were achieved by adding ammonium hydrogen fluoride in addition to the ingredients explicitly shown in the table, until the free fluoride reading was closely approached, then measuring the pH value, and if needed lowering it by addition of small amounts of hydrofluoric acid in addition to the ingredients explicitly shown in the table, with further alternating additions of ammonium hydrogen fluoride and hydrofluoric acid if needed until both the final free fluoride and pH values were achieved.

Also in this group, an additional test named "wetting tension" was performed by applying to the coated surface from a clean cotton swab a stripe of at least one of several solutions of known surface tension supplied by Diversified Enterprises, Claremont, N.H. The solutions were applied in order of increasing surface tension, until the last one failed to wet the surface. The surface tension of the preceding highest surface tension solution that had wet the surface was taken as the "wetting tension" of the surface. The higher this value, the more likely is the desirable result that the coated surface will be uniformly wet by any subsequent treatment liquid applied to it. The units for this measurement shown in the following tables are milliNewtons per meter.

Table 3 below shows the compositions used in this group and the corresponding test results obtained. Each line in Table 3 describes an example according to the invention, unless the letter "C" appears in the first cell in the line to show that it is a comparison example instead.

The first six lines in Table 3 show that both zirconium and polymer are required for an acceptable result, and all of these compositions also contain at least ammonium hydrogen fluoride as component (B). The next six lines of Table 3 show that, contrary to some reports in technical literature and patents, in these compositions sulfate as a source of aluminum does not impair the results, compared with nitrate as a source of aluminum. The next six lines of Table 3 show that each of hexafluorozirconic acid, gluconic acid, and fluoroboric acid can be increased to at least as much as five times one of its most preferred concentrations, and aluminum cations can be increased to ten times one of their most preferred concentrations, while all of the other ingredients are kept at the lower highly preferred concentration, without impairing the quality of the test results achieved, but that polymer can not be raised to as much as five times its concentration in this highly preferred composition without

TABLE 3

| Characteristics of the Composition | | | | | | | | Test Results | | |
|---|---|---|---|---|---|---|---|---|---|---|
| Grams per Liter of Composition of: | | | | | Two | Aluminum in Composition: | | | | |
| $H_2ZrF_6$ | $H_2TiF_6$ | Gluconic Acid | Polymer | $HBF_4$ | Liquid Phases? | Ppm | Source | Dome Stain | Retort Stain | Wetting Tension |
| 0.18 | 0.00 | 0.035 | 0.09 | 0.00 | No | 75 | Nitrate | 4 | 5 | 58 |
| 0.00 C | 0.00 | 0.035 | 0.09 | 0.00 | No | 75 | Nitrate | 1 | 2 | 42 |
| 0.18 | 0.00 | 0.00 | 0.09 | 0.00 | No | 75 | Nitrate | 4 | 5 | 60 |
| 0.18 C | 0.00 | 0.035 | 0.00 | 0.00 | No | 75 | Nitrate | 4 | 2 | 60 |
| 0.00 C | 0.00 | 0.00 | 0.09 | 0.00 | No | 75 | Nitrate | 1 | 2 | 60 |
| 0.18 | 0.00 | 0.035 | 0.09 | 0.053 | No | 75 | Nitrate | 4 | 5 | 58 |
| 0.18 | 0.00 | 0.035 | 0.09 | 0.00 | No | 0 | None | 4 | 5 | 58 |
| 0.18 | 0.00 | 0.035 | 0.09 | 0.00 | No | 75 | Nitrate | 4 | 5 | 58 |
| 0.18 | 0.00 | 0.035 | 0.09 | 0.00 | No | 150 | Nitrate | 4 | 5 | 58 |
| 0.18 | 0.00 | 0.035 | 0.09 | 0.00 | No | 0 | None | 4 | 5 | 60 |
| 0.18 | 0.00 | 0.035 | 0.09 | 0.00 | Yes | 75 | Sulfate | 4 | 5 | 58 |
| 0.18 | 0.00 | 0.035 | 0.09 | 0.00 | Yes | 150 | Sulfate | 4 | 5 | 56 |
| 0.18 | 0.00 | 0.035 | 0.09 | 0.053 | Yes | 75 | Nitrate | 4 | 4 | 60 |
| 0.93 | 0.00 | 0.035 | 0.09 | 0.053 | Yes | 75 | Nitrate | 4 | 5 | 56 |
| 0.18 | 0.00 | 0.18 | 0.09 | 0.053 | No | 75 | Nitrate | 4 | 5 | 56 |
| 0.18 C | 0.00 | 0.035 | 0.45 | 0.053 | No | 75 | Nitrate | 3.5 | 3 | 58 |
| 0.18 | 0.00 | 0.035 | 0.09 | 0.28 | No | 75 | Nitrate | 4 | 4 | 58 |
| 0.18 | 0.00 | 0.035 | 0.09 | 0.053 | No | 750 | Nitrate | 4 | 4 | 60 |
| 0.18 | 0.00 | 0.035 | 0.09 | 0.00 | Yes | 60 | Nitrate | 4 | 5 | 58 |
| 0.13 | 0.042 | 0.035 | 0.09 | 0.00 | No | 60 | Nitrate | 4 | 5 | 58 |
| 0.094 | 0.072 | 0.035 | 0.09 | 0.00 | No | 60 | Nitrate | 4 | 5 | 58 |
| 0.054C | 0.10 | 0.035 | 0.09 | 0.00 | No | 60 | Nitrate | 3.5 | 4 | 58 |
| 0.00 C | 0.15 | 0.035 | 0.09 | 0.00 | No | 60 | Nitrate | 3 | 2 | 58 |

impairing the results achieved. The remaining five lines in Table 3 show that at least as much as 50, but not as much as 70, mole percent of the zirconium in a highly preferred composition according to the invention can be replaced with titanium without impairing the quality of the results.

Example and Comparison Example Group 4

In this group, the effects of variations in the concentration of zirconium, in two different commercial sources of hexafluorozirconic acid, and in polymer concentration were determined, and the deleterious effect of phosphate was demonstrated. Processing and testing conditions were the same as for Group 3, except as follows:

In the examples according to the invention, the polymer was the same as for the preceding groups, while in some comparison examples a polymer generally similar but made by a process that does not require the use of solvent was used. The characteristic believed most important about this latter polymer was not the difference in manufacturing process but the fact that the polymer was in an aqueous dispersion that contained phosphoric acid in a concentration by mass corresponding to 0.15 times the mass of the polymer.

Hexafluorozirconic acid is commercially available at two concentrations in water solution. Solutions containing 45% of $H_2ZrF_6$ are light green in color. This color is believed to be due to small contents of transition metal cations such as $Ni^{+2}$ and/or $Fe^{+2}$, which might be thought to have some effect on the coatings formed from compositions in which the hexafluorozirconic acid was provided from this source. Water solutions containing 20.8% of $H_2ZrF_6$ are also available and are colorless. Only the more concentrated source of hexafluorozirconic acid was used in previous Groups, but in this one both sources were tested.

The variations in the specific compositions used and the test results obtained are shown in Table 4 below. In addition to the materials shown in Table 4, all of the compositions contained: 0.035 g/l of gluconic acid; sufficient ammonium hydrogen fluoride and, if needed, hydrofluoric acid to produce a pH value of 3.2 and a free fluoride reading of −90 mv for the composition; and water to constitute the balance of the composition not otherwise specified. These results indicate that:

If there is any significant difference between the performance of the two concentrations of the source of hexafluorozirconic acid, the higher concentration source is slightly favored. Because it is also less expensive per unit content of zirconium than the lower concentration material, the higher concentration source is preferred.

In the absence of phosphate and in conjunction with polymer and the other required ingredients, any concentration of zirconium at least as great as 0.04 g/l from the more concentrated commercial hexafluorozirconic acid and any concentration of zirconium of at least 0.08 g/l from either commercial concentration of hexafluorozirconic acid produces fully acceptable dome stain and retort stain resistances.

A concentration ratio of polymer to zirconium that is greater than 1.6 is disfavored, because it results in at least slightly less (although still acceptable) retort stain resistance and also increases the cost. (As already shown in Group 3, still higher ratios of polymer to zirconium can make the retort stain and dome stain results unacceptable.)

TABLE 4

| Identifying | Zirconium | | Polymer | | Test Results | |
|---|---|---|---|---|---|---|
| Number | g/l | Source | g/l | Phosphate? | Dome Stain | Retort Stain |
| 4.1 | 0.082 | 45% $H_2ZrF_6$ | 0.090 | No | 4 | 5 |
| 4.2 | 0.062 | 45% $H_2ZrF_6$ | 0.090 | No | 4 | 5 |
| 4.3 | 0.041 | 45% $H_2ZrF_6$ | 0.090 | No | 4 | 4 |
| 4.4 | 0.020 | 45% $H_2ZrF_6$ | 0.090 | No | 3 | 3 |
| 4.5 | 0.082 | 45% $H_2ZrF_6$ | 0.067 | No | 4 | 5 |
| 4.6 | 0.062 | 45% $H_2ZrF_6$ | 0.067 | No | 4 | 5 |
| 4.7 | 0.041 | 45% $H_2ZrF_6$ | 0.067 | No | 4 | 4 |
| 4.8 | 0.020 | 45% $H_2ZrF_6$ | 0.067 | No | 3 | 2 |
| 4.9 | 0.082 | 45% $H_2ZrF_6$ | 0.045 | No | 4 | 5 |
| 4.10 | 0.062 | 45% $H_2ZrF_6$ | 0.045 | No | 4 | 5 |
| 4.11 | 0.041 | 45% $H_2ZrF_6$ | 0.045 | No | 4 | 5 |
| 4.12 | 0.020 | 45% $H_2ZrF_6$ | 0.045 | No | 3 | 2 |
| 4.13 | 0.082 | 45% $H_2ZrF_6$ | 0.022 | No | 4 | 5 |
| 4.14 | 0.062 | 45% $H_2ZrF_6$ | 0.022 | No | 4 | 5 |
| 4.15 | 0.041 | 45% $H_2ZrF_6$ | 0.022 | No | 4 | 5 |
| 4.16 | 0.020 | 45% $H_2ZrF_6$ | 0.022 | No | 3 | 3 |
| 4.17 | 0.085 | 20.8% $H_2ZrF_6$ | 0.090 | No | 4 | 5 |
| 4.18 | 0.043 | 20.8% $H_2ZrF_6$ | 0.090 | No | 4 | 3 |
| 4.19 | 0.082 | 45% $H_2ZrF_6$ | 0.076 | Yes | 4 | 3 |
| 4.20 | 0.082 | 45% $H_2ZrF_6$ | 0.038 | Yes | 4 | 3 |

Example and Comparison Example Group 5

In this group, the use of salts of polyacids as component (C) was demonstrated. General processing conditions were the same as for Group 3, except as follows:

In Stage 2, the cleaner composition had 10 points of Free Acid and 30 points of Total Acid and a mv reading of 0.

Characteristics of the working compositions were those shown in Table 5 below in addition to the following standard ingredients and/or conditions:

aluminum nitrate to give a stoichiometric equivalent as $Al^{+3}$ of 0.075 g/l;

0.035 g/l of gluconic acid;

0.186 g/l of hexafluorozirconic acid;

0.065 g/l of polymer or other polyacid ingredient;

−90 mv of free fluoride;

a pH value of 3.2; and

The Spreading Test shown in Table 5 was performed in the same manner as the Wetting Test in Group 3, except that the test liquid was required only to spread rather than to completely wet the tested surface.

The ingredients identified by trademarks in Table 5 were all supplied by Rohm & Haas, except for DIACID™ 1550, which was supplied by Westvaco. The available information about these materials as described by their suppliers is as follows:

TABLE 5

| | | Test Results | | | |
|---|---|---|---|---|---|
| | Polyacid | Stain Test Ratings for: | | Surface Energies, Dynes/Centimeter, for | |
| Identifier | Ingredient | Dome | Retort | Spreading | Wetting |
| Example 5.1 | ACCUMER ™ 1000 | 4 | 5 | 44 | 60 |
| Example 52 | ACCUMER ™ 1100 | 4 | 5 | 46 | 60 |

TABLE 5-continued

| Identifier | Polyacid Ingredient | Test Results: Stain Test Ratings for: Dome | Retort | Surface Energies, Dynes/Centimeter, for: Spreading | Wetting |
|---|---|---|---|---|---|
| Example 5.3 | ACCUMER ™ 3100 | 4 | 5 | 40 | 60 |
| Example 5.4 | ACCUMER ™ 4161 | 4 | 5 | 48 | 62 |
| Example 5.5 | TAMOL ™ 731A | 4 | 5 | 38 | 64 |
| Example 5.6 | OPTIDOSE ™ 4210 | 4 | 5 | 40 | 60 |
| Comparison 5 | DIACID ™ 1550 | 4 | 3.5 | 36 | 58 |

ACCUMER™ 1000 and 1100 products were both described as sodium salts of polycarboxylic acid, with exact structure proprietary but molecular weights of $2.0\times10^3$ and $4.5\times10^3$ respectively. ACCUMER™ 3100 was described as a terpolymer of a nonionic, a carboxylate, and a sulfonate with a molecular weight of $4.5\times10^3$. ACCUMER™ 4161 was described as a phosphino carboxylate polymer with a molecular weight of $3.6\times10^3$. TAMOL™ 731A was described as a sodium salt of a maleic anhydride copolymer with a molecular weight of $1.5\times10^4$. OPTIDOSE™ 4210 was described as polymaleic acid with a molecular weight of $5\times10^2$ to $10^3$. DIACID™ 1550 was described as having molecules consisting of a cyclohexene ring with three substituents, one hexyl moiety, one carboxyl moiety, and one ω-carboxyheptyl moiety.

The results in Table 5 indicate that all of the materials tested, except the nonpolymeric comparison example, produced fully satisfactory stain resistance.

What is claimed is:

1. An aqueous liquid composition suitable, optionally after dilution with water, for forming a colorless transparent conversion coating on a metal substrate, said liquid composition comprising water and the following components:

(A) a component of one or more dissolved transition metal compounds that contains zirconium and may also include titanium, said component comprising at least about 0.25 mM/l of total zirconium and titanium atoms, provided that zirconium constitutes more than 30% of the moles of the total moles of zirconium and titanium;

(B) a component of at least one dissolved compound that contains inorganically bonded fluorine and is not part of component (A), such that the molar ratio of fluorine atoms to the total of zirconium and titanium atoms is at least 6.05:1:00 and a fluoride sensitive electrode in contact with the composition has a potential that is from about −200 to about 100 mv when compared with the same fluoride sensitive electrode in contact with Standard Solution 120 MC; and (C) a component of dissolved organic polymer molecules, wherein component (C) constitutes at least about 0.009 g/l of the composition and contains at least one of:

a sufficient number of acid moieties that the number ratio of acid moieties to total carbon atoms within component (C) is at least about 1.0:9.0; and a sufficient number of nucleophilic moieties that the number ratio of nucleophilic moieties to total carbon atoms within component (C) is at least about 1.0:50.

2. An aqueous liquid composition suitable, optionally after dilution with water, for forming a colorless transparent conversion coating on a metal substrate, said liquid composition comprising water and the following components:

(A) a component of one or more dissolved transition metal compounds that contains zirconium and may also include titanium, said component (A) comprising at least about 0.45 mM/l of total zirconium and titanium atoms and at least about 50 mole percent of the total is zirconium;

(B) a component of at least one dissolved compound that contains Inorganically bonded fluorine and is not part of component (A), such that the molar ratio of fluorine atoms to the total of zirconium and titanium atoms is at least 6.15:1:00 and a fluoride sensitive electrode in contact with the composition has a potential that is from about −130 to about −10 mv when compared with the same fluoride sensitive electrode in contact with Standard Solution 120 MC; and (C) a component of dissolved organic polymer molecules comprising at least about 0.045 g/l of polymer molecules that have an average molecular weight of at least 1500 Daltons and that contain, as at least 10% of their total mass, one or more aminomethylphenyl moieties, each of which conforms to the following general formula:

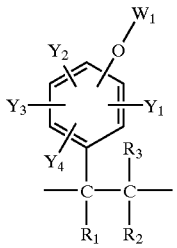

wherein:

each of $R^1$ through $R^3$ is selected, independently of each other and independently from one aminomethylphenyl moiety of the component to another, from the group consisting of a hydrogen moiety, an alkyl moiety with from 1 to 5 carbon atoms, and an aryl moiety with from 6 to 18 carbon atoms;

each of $Y^1$ through $Y^3$ is selected, independently of each other and independently from one aminomethylphenyl moiety to another, from the group consisting of: a hydrogen moiety; a —$CH_2Cl$ moiety; an alkyl moiety with from 1 to 18 carbon atoms; an aryl moiety with from 6 to 18 carbon atoms; a moiety conforming to the general formula —$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

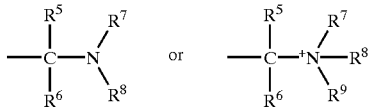

wherein:

each of $R^5$ through $R^7$ is selected, independently of each other and independently from one aminomethylphenyl moiety to another, from the group consisting of a hydrogen moiety, an alkyl moiety, an aryl moiety, a hydroxyalkyl moiety, an aminoalkyl moiety, a mercaptoalkyl moiety, and a phosphoalkyl moiety; $R^8$ is a polyhydroxy alkyl moiety and $R^9$ is selected from the group consisting of a hydrogen moiety, an alkyl moiety, an aryl moiety, a hydroxy or polyhydroxy alkyl moiety, an amino or polyamino alkyl moiety, a mercapto or polymercapto alkyl moiety, a phospho or polyphospho alkyl moiety, an $—O^-$ moiety, and an —OH moiety;

$Y^4$ is a moiety Z as above defined; and $W^1$ is selected, independently from one molecule of the component to another and from one to another aminomethylphenyl moiety, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, or unsubstituted alkylbenzyl moiety; a halo or polyhalo alkyl, or halo or polyhalo alkenyl, moiety; a moiety derived from a condensation polymerization product of ethylene oxide, propyfene oxide or a mixture thereof by deleting one hydrogen atom therefrom; and a sodium, potassium, lithium, ammonium or substituted ammonium, or phosphonium or substituted phosphonium cation moiety;

component (C) contains at least one of:

a sufficient number of acid moieties that the number ratio of acid moieties to total carbon atoms within component (C) is at least about 1.0:9.0; and a sufficient number of nucleophilic moieties that the number ratio of nucleophilic moieties to total carbon atoms within component (C) is at least about 1.0:50;

in component (C) there is a sufficient number of amino nitrogen atoms that the number ratio of amino nitrogen atoms to total carbon atoms in component (C) is at least about 1.0:40;

the composition comprises at least about 0.060 mM/l of chelating agent molecules selected from the group consisting of molecules each of which contains at least two nucleophilic moieties selected from the group consisting of carboxyl, carboxylate, noncarboxyl hydroxyl, amino, thio, phosphonic acid, phosphonate, phosphinic acid, and phosphinate moieties, with these at least two moieties being bonded into the molecule in positions such that a five- or six-membered ring of atoms can be formed by atoms in the molecule and a multivalent metal atom that is coordinatively covalently bonded to a nucleophilic atom selected from a group consisting of oxygen, amino nitrogen, thio sulfur, or phosphinic phosphorus, in each of said nucleophilic moieties in the molecule; and the pH value of the composition is from about 2.5 to about 4.1.

3. A composition according to claim 2, wherein:

component (A) constitutes at least about 0.7 and not more than about 3.0 mM/l of total zirconium and titanium atoms;

there is a molar ratio of fluorine atoms to the total of zirconium and titanium atoms that is at least about 6.20:1.00;

a fluoride sensitive electrode in contact with the composition has a potential that is from about −100 to about −70 mv when compared with the same fluoride sensitive electrode in contact with Standard Solution 120 MC;

component (C) constitutes at least about 0.060 g/l of polymer molecules that have an average molecular weight of at least 1500 Daltons and that contain, as at least 50% of their total mass, one or more aminomethylphenyl moieties that conform to the general formulas for such moieties given above when:

each of $R^1$ through $R^3$, $R^5$, $R^6$, $Y^1$ through $Y^3$, and $W^1$ is a hydrogen moiety;

$R^7$ is an alkyl moiety having not more than 3 carbon atoms;

$R^8$ is a moiety conforming to the general formula $—CH_2(CHOH)_p—H$, where p is an integer that is 4, 5, or 6; and $R^9$ is not present;

in component (C) there is a sufficient number of amino nitrogen atoms that the number ratio of amino nitrogen atoms to total carbon atoms in component (C) is at least about 1.0:22;

the composition comprises at least about 0.060 mM/l of chelating agent molecules selected from the group consisting of gluconic, citric, tartaric, and malic acids and the water soluble salts of all of these acids; and the pH value of the composition is from about 2.9 to about 3.5.

4. An aqueous liquid composition suitable, optionally after dilution with water, for forming a colorless transparent conversion coating on a metal substrate, said liquid composition comprising water and the following components:

(A) a component of one or more dissolved transition metal compounds that contains zirconium and may also include titanium, said component (A) comprising at least about 0.45 mM/l of total zirconium and titanium atoms and at least about 50 mole percent of the total is zirconium;

(B) a component of at least one dissolved compound that contains inorganically bonded fluorine and is not part of component (A), such that the molar ratio of fluorine atoms to the total of zirconium and titanium atoms is at least 6.15:1:00 and a fluoride sensitive electrode in contact with the composition has a potential that is from about −130 to about −10 mv when compared with the same fluoride sensitive electrode in contact with Standard Solution 120 MC; and;

(C) a component of dissolved organic polymer molecules comprising at least about 0.009 g/l of the composition and containing at least one of:

a sufficient number of acid moieties that the number ratio of acid moieties to total carbon atoms within component (C) is at least about 1.0:9.0; and a sufficient number of nucleophilic moieties that the number ratio of nucleophilic moieties to total carbon atoms within component (C) is at least about 1.0:50;

component (C) comprises a sufficient number of acidic moieties that the number ratio of acidic moieties to total carbon atoms is at least about 1.0:8.0;

the composition comprises at least about 0.060 mM/l of chelating agent molecules selected from the group consisting of molecules each of which contains at least two nucleophilic moieties selected from the group consisting of carboxyl, carboxylate, noncarboxyl hydroxyl, amino, thio, phosphonic acid, phosphonate, phosphinic acid, and phosphinate moieties, with these at least two moieties being bonded into the molecule in positions such that a five- or six-membered ring of atoms can be formed by atoms in the molecule and a multivalent metal atom that is coordinatively covalently bonded to a nucleophilic atom selected from a group consisting of oxygen, amino nitrogen, thio sulfur, or phosphinic phosphorus, in each of said nucleophilic moieties in the molecule; and the pH value of the composition is from about 2.5 to about 4.1.

5. A composition according to claim 4, wherein:

component (A) constitutes at least about 0.7 and not more than about 3.0 mM/l of total zirconium and titanium atoms;

there is a molar ratio of fluorine atoms to the total of zirconium and titanium atoms that is at least about 6.20:1.00;

a fluoride sensitive electrode in contact with the composition has a potential that is from about −100 to about −70 mv when compared with the same fluoride sensitive electrode in contact with Standard Solution 120 MC;

component (C) constitutes at least about 0.050 g/l of polymer molecules that have an average molecular weight of at least 500 Daltons and that are polymers of at least one of maleic, acrylic, and methacrylic acids and salts of all of these acids;

in component (C) there is a sufficient number of carboxylate moieties that the number ratio of carboxylate moieties to total carbon atoms in component (C) is at least about 1.0:4.0;

the composition comprises at least about 0.060 mM/l of chelating agent molecules selected from the group consisting of gluconic, citric, tartaric, and malic acids and the water soluble salts of all of these acids; and the pH value of the composition is from about 2.9 to about 3.5.

6. A concentrate composition according to claim 1, wherein:

component (A) constitutes at least about 45 mM/l of total zirconium and titanium atoms and at least about 50 mole percent of the total is zirconium;

there is a molar ratio of fluorine atoms to the total of zirconium and titanium atoms that is at least about 6.15:1.00;

component (C) constitutes at least about 4.5 g/l of polymer molecules that have an average molecular weight of at least 1500 Daltons and that contain, as at least 10% of their total mass, one or more aminomethylphenyl moieties, each of which conforms to the following general formula:

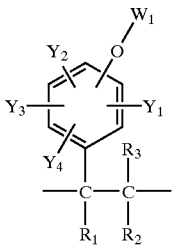

wherein:

each of $R^1$ through $R^3$ is selected, independently of each other and independently from one aminomethylphenyl moiety of the component to another, from the group consisting of a hydrogen moiety, an alkyl moiety with from 1 to 5 carbon atoms, and an aryl moiety with from 6 to 18 carbon atoms;

each of $Y^1$ through $Y^3$ is selected, independently of each other and independently from one aminomethylphenyl moiety to another, from the group consisting of: a hydrogen moiety; a —$CH_2Cl$ moiety; an alkyl moiety with from 1 to 18 carbon atoms; an aryl moiety with from 6 to 18 carbon atoms; a moiety conforming to the general formula —$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

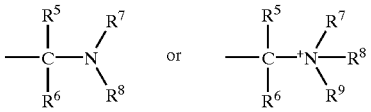

wherein:

each of $R^5$ through $R^7$ is selected, independently of each other and independently from one aminomethylphenyl moiety to another, from the group consisting of a hydrogen moiety, an alkyl moiety, an aryl moiety, a hydroxyalkyl moiety, an aminoalkyl moiety, a mercaptoalkyl moiety, and a phosphoalkyl moiety; $R^8$ is a polyhydroxy alkyl moiety and $R^9$ is selected from the group consisting of a hydrogen moiety, an alkyl moiety, an aryl moiety, a hydroxy or polyhydroxy alkyl moiety, an amino or polyamino alkyl moiety, a mercapto or polymercapto alkyl moiety, a phospho or polyphospho alkyl moiety, an —$O^-$ moiety, and an —OH moiety;

$Y^4$ is a moiety Z as above defined; and $W^1$ is selected, independently from one molecule of the component to another and from one to another aminomethylphenyl moiety, from the group consisting of a hydrogen moiety, an acyl moiety, an acetyl moiety, a benzoyl moiety; a 3-allyloxy-2-hydroxy-propyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, or unsubstituted alkylbenzyl moiety; a halo or polyhalo alkyl, or halo or polyhalo alkenyl, moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety;

in component (C) there is a sufficient number of amino nitrogen atoms that the number ratio of amino nitrogen atoms to total carbon atoms in component (C) is at least about 1.0:40;

the composition comprises at least about 6.0 mM/l of chelating agent molecules selected from the group consisting of molecules each of which contains at least two nucleophilic moieties selected from the group consisting of carboxyl, carboxylate, non-carboxyl hydroxyl, amino, thio, phosphonic acid, phosphonate, phosphinic acid, and phosphinate moieties, with these at least two moieties being bonded into the molecule in positions such that a five- or six-membered ring of atoms can be formed by atoms in the molecule and a multivalent metal atom that is coordinatively covalently bonded to a nucleophilic atom (oxygen, amino nitrogen, thio sulfur, or phosphinic phosphorus) in each of said nucleophilic moieties in the molecule.

7. A concentrate composition according to claim 1, wherein:

component (A) constitutes at least about 45 mM/l of total zirconium and titanium atoms and at least about 50 mole percent of the total is zirconium;

there is a molar ratio of fluorine atoms to the total of zirconium and titanium atoms that is at least about 6.15:1.00;

component (C) comprises a sufficient number of acidic moieties that the number ratio of acidic moieties to total carbon atoms is at least about 1.0:8.0;

the composition comprises at least about 6.0 mM/l of chelating agent molecules selected from the group consisting of molecules each of which contains at least two nucleophilic moieties selected from the group consisting of carboxyl, carboxylate, non-carboxyl hydroxyl, amino, thio, phosphonic acid, phosphonate, phosphinic acid, and phosphinate moieties, with these at least two moieties being bonded into the molecule in positions such that a five- or six-membered ring of atoms can be formed by atoms in the molecule and a multivalent metal atom that is coordinatively covalently bonded to a nucleophilic atom (oxygen, amino nitrogen, thio sulfur, or phosphinic phosphorus) in each of said nucleophilic moieties in the molecule.

8. An aqueous liquid composition suitable for forming a colorless transparent conversion coating on a metal substrate, said liquid composition having been made by mixing a first mass of water with at least the following additional materials:

(A) a second mass of one or more dissolved transition metal compounds that contain zirconium and may also include titanium, said component comprising at least about 0.25 mM/l of total zirconium and titanium atoms, provided that zirconium constitutes more than 30% of the moles of the total moles of zirconium and titanium;

(B) a third mass of at least one dissolved material that contains inorganically bonded fluorine and is not part of said second mass, such that the molar ratio of fluorine to the total of zirconium and titanium is at least 6.05:1:00 and a fluoride sensitive electrode in contact with the composition has a potential that is from about −200 to about 100 mv when compared with the same fluoride sensitive electrode in contact with Standard Solution 120 MC; and (C) a fourth mass of dissolved organic polymer molecules, wherein said fourth mass constitutes at least about 0.009 g/l of the composition and contains at least one of:

a sufficient number of acid moieties that the number ratio of acid moieties to total carbon atoms within component (C) is at least about 1.0:9.0; and a sufficient number of nucleophilic moieties that the number ratio of nucleophilic moieties to total carbon atoms within component (C) is at least about 1.0:50.

9. A composition according to claim 8, wherein:

said second mass comprises a number of zirconium and titanium atoms to provide at least about 0.45 mM/l of total zirconium and titanium atoms to the total composition and at least about 50 mole percent of the total of zirconium and titanium is zirconium;

there is a molar ratio of fluorine atoms to the total of zirconium and titanium atoms that is at least about 6.15:1.00;

a fluoride sensitive electrode in contact with the composition has a potential that is from about −130 to about −10 mv when compared with the same fluoride sensitive electrode in contact with Standard Solution 120 MC;

said fourth mass provides to the total composition at least about 0.045 f/l of polymer molecules that have an average molecular weight of at least 1500 Daltons and that contain, as at least 10% of their total mass, one or more aminomethylphenyl moieties, each of which conforms to the following general formula:

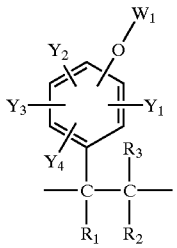

wherein:

each of $R^1$ through $R^3$ is selected, independently of each other and independently from one aminomethylphenyl moiety of the component to another, from the group consisting of a hydrogen moiety, an alkyl moiety with from 1 to 5 carbon atoms, and an aryl moiety with from 6 to 18 carbon atoms;

each of $Y^1$ through $Y^3$ is selected, independently of each other and independently from one aminomethylphenyl moiety to another, from the group consisting of: a hydrogen moiety; a $—CH_2Cl$ moiety; an alkyl moiety with from 1 to 18 carbon atoms; an aryl moiety with from 6 to 18 carbon atoms; a moiety conforming to the general formula $—CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

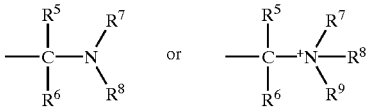

wherein:

each of $R^5$ through $R^7$ is selected, independently of each other and independently from one aminomethylphenyl moiety to another, from the group consisting of a hydrogen moiety, an alkyl moiety, an aryl moiety, a hydroxyalkyl moiety, an aminoalkyl moiety, a mercaptoalkyl moiety, and a phosphoalkyl moiety; $R^8$ is a polyhydroxy alkyl moiety and $R^9$ is selected from the group consisting of a hydrogen moiety, an alkyl moiety, an aryl moiety, a hydroxy or polyhydroxy alkyl moiety, an amino or polyamino alkyl moiety, a mercapto or polymercapto alkyl moiety, a phospho or polyphospho alkyl moiety, an —$O^-$ moiety, and an —OH moiety;

$Y^4$ is a moiety Z as above defined; and $W^1$ is selected, independently from one molecule of the component to another and from one to another aminomethylphenyl moiety, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, or unsubstituted alkylbenzyl moiety; a halo or polyhalo alkyl, or halo or polyhalo alkenyl, moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety;

in component (C) there is a sufficient number of amino nitrogen atoms that the number ratio of amino nitrogen atoms to total carbon atoms in component (C) is at least about 1.0:40;

the materials mixed to make the composition additionally include a fifth mass that provides to the composition at least about 0.060 mM/l of chelating agent molecules selected from the group consisting of molecules each of which contains at least two nucleophilic moieties selected from the group consisting of carboxyl, carboxylate, noncarboxyl hydroxyl, amino, thio, phosphonic acid, phosphonate, phosphinic acid, and phosphinate moieties, with these at least two moieties being bonded into the molecule in positions such that a five- or six-membered ring of atoms can be formed by atoms in the molecule and a multivalent metal atom that is coordinatively covalently bonded to a nucleophilic atom selected from a group consisting of oxygen, amino nitrogen, thio sulfur, or phosphinic phosphorus, in each of said nucleophilic moieties in the molecule; and the pH value of the composition is from about 2.5 to about 4.1.

10. A composition according to claim 9, wherein:

said second mass provides to the composition at least about 0.7 and not more than about 3.0 mM/l of total zirconium and titanium atoms;

there is a molar ratio of fluorine atoms to the total of zirconium and titanium atoms that is at least about 6.20:1.00;

a fluoride sensitive electrode in contact with the composition has a potential that is from about −100 to about −70 mv when compared with the same fluoride sensitive electrode in contact with Standard Solution 120 MC;

said fourth mass provides to the composition at least about 0.060 g/l of polymer molecules that have an average molecular weight of at least 1500 Daltons and that contain, as at least 50% of their total mass, one or more aminomethylphenyl moieties that conform to the general formulas for such moieties given in claim 9 when:

each of $R^1$ through $R^3$, $R^5$, $R^6$, $Y^1$ through $Y^3$, and $W^1$ is a hydrogen moiety;

$R^7$ is an alkyl moiety having not more than 3 carbon atoms;

$R^8$ is a moiety conforming to the general formula —$CH_2(CHOH)_p$—H, where p is an integer that is 4, 5, or 6; and $R^9$ is not present;

in said fourth mass there is a sufficient number of amino nitrogen atoms that the number ratio of amino nitrogen atoms to total carbon atoms in said fourth mass is at least about 1.0:22;

said fifth mass provides to the composition at least about 0.060 mM/l of chelating agent molecules selected from the group consisting of gluconic, citric, tartaric, and malic acids and the water soluble salts of all of these acids; and the pH value of the composition is from about 2.9 to about 3.5.

11. A composition according to claim 8, wherein:

said second mass provides to the composition at least about 0.45 mM/l of total zirconium and titanium atoms and at least about 50 mole percent of the total is zirconium;

there is a molar ratio of fluorine atoms to the total of zirconium and titanium atoms that is at least about 6.15:1.00;

a fluoride sensitive electrode in contact with the composition has a potential that is from about −130 to about −10 mv when compared with the same fluoride sensitive electrode in contact with Standard Solution 120 MC:

said fourth mass comprises a sufficient number of acidic moieties that the number ratio of acidic moieties to total carbon atoms is at least about 1.0:8.0;

the materials mixed to make the composition additionally include a fifth mass that provides to the composition at least about 0.060 mM/l of chelating agent molecules selected from the group consisting of molecules each of which contains at least two nucleophilic moieties selected from the group consisting of carboxyl, carboxylate, noncarboxyl hydroxyl, amino, thio, phosphonic acid, phosphonate, phosphinic acid, and phosphinate moieties, with these at least two moieties being bonded into the molecule in positions such that a five- or six-membered ring of atoms can be formed by atoms in the molecule and a multivalent metal atom that is coordinatively covalently bonded to a nucleophilic atom selected from a group consisting oxygen, amino nitrogen, thio sulfur, or phosphinic phosphorus, in each of said nucleophilic moieties in the molecule; and the pH value of the composition is from about 2.5 to about 4.1.

12. A composition according to claim 11, wherein:

said second mass provides to the composition at least about 0.7 and not more than about 3.0 mM/l of total zirconium and titanium atoms;

there is a molar ratio of fluorine atoms to the total of zirconium and titanium atoms that is at least about 6.20:1.00;

a fluoride sensitive electrode in contact with the composition has a potential that is from about −100 to about −70 mv when compared with the same fluoride sensitive electrode in contact with Standard Solution 120 MC;

said fourth mass provides to the composition at least about 0.050 g/l of polymer molecules that have an average molecular weight of at least 500 Daltons and that are polymers of at least one of maleic, acrylic, and methacrylic acids and salts of all of these acids;

in said fourth mass there is a sufficient number of carboxylate moieties that the number ratio of carboxylate moieties to total carbon atoms in said fourth mass is at least about 1.0:4.0;

said fifth mass provides to the composition at least about 0.060 mM/l of chelating agent molecules selected from the group consisting of gluconic, citric, tartaric, and malic acids and the water soluble salts of all of these acids; and the pH value of the composition is from about 2.9 to about 3.5.

13. A concentrate composition according to claim 8, wherein:

said second mass comprises a number of zirconium and titanium atoms to provide at least about 45 mM/l of total zirconium and titanium atoms to the total composition and at least about 50 mole percent of the total of zirconium and titanium is zirconium;

there is a molar ratio of fluorine atoms to the total of zirconium and titanium atoms that is at least about 6.15:1.00;

said fourth mass provides to the total composition at least about 4.5 g/l of polymer molecules that have an average molecular weight of at least 1500 Daltons and that contain, as at least 10% of their total mass, one or more aminomethylphenyl moieties, each of which conforms to the following general formula:

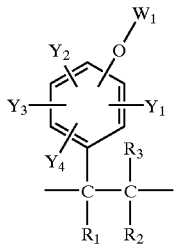

wherein:

each of $R^1$ through $R^3$ is selected, independently of each other and independently from one aminomethylphenyl moiety of the component to another, from the group consisting of a hydrogen moiety, an alkyl moiety with from 1 to 5 carbon atoms, and an aryl moiety with from 6 to 18 carbon atoms;

each of $Y^1$ through $Y^3$ is selected, independently of each other and independently from one aminomethylphenyl moiety to another, from the group consisting of: a hydrogen moiety; a $—CH_2Cl$ moiety; an alkyl moiety with from 1 to 18 carbon atoms; an aryl moiety with from 6 to 18 carbon atoms; a moiety conforming to the general formula $—CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

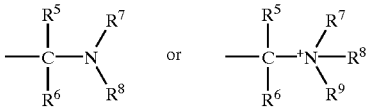

wherein:

each of $R^5$ through $R^7$ is selected, independently of each other and independently from one aminomethylphenyl moiety to another, from the group consisting of a hydrogen moiety, an alkyl moiety, an aryl moiety, a hydroxyalkyl moiety, an aminoalkyl moiety, a mercaptoalkyl moiety, and a phosphoalkyl moiety; $R^8$ is a polyhydroxy alkyl moiety and $R^9$ is selected from the group consisting of a hydrogen moiety, an alkyl moiety, an aryl moiety, a hydroxy or polyhydroxy alkyl moiety, an amino or polyamino alkyl moiety, a mercapto or polymercapto alkyl moiety, a phospho or polyphospho alkyl moiety, an $—O^-$ moiety, and an —OH moiety;

$Y^4$ is a moiety Z as above defined; and $W^1$ is selected, independently from one molecule of the component to another and from one to another aminomethylphenyl moiety, from the group consisting of a hydrogen moiety, an acyl moiety, an acetyl moiety, a benzoyl moiety; a 3-allyloxy-2-hydroxy-propyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, or unsubstituted alkylbenzyl moiety; a halo or polyhalo alkyl, or halo or polyhalo alkenyl, moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety;

in component (C) there is a sufficient number of amino nitrogen atoms that the number ratio of amino nitrogen atoms to total carbon atoms in component (C) is at least about 1.0:40; and the materials mixed to make the composition additionally include a fifth mass that provides to the composition at least about 6.0 mM/l of chelating agent molecules selected from the group consisting of molecules each of which contains at least two nucleophilic moieties selected from the group consisting of carboxyl, carboxylate, non-carboxyl hydroxyl, amino, thio, phosphonic acid, phosphonate, phosphinic acid, and phosphinate moieties, with these at least two moieties being bonded into the molecule in positions such that a five- or six-membered ring of atoms can be formed by atoms in the molecule and a multivalent metal atom that is coordinatively covalently bonded to a nucleophilic atom (oxygen, amino nitrogen, thio sulfur, or phosphinic phosphorus) in each of said nucleophilic moieties in the molecule.

14. A concentrate composition according to claim 8, wherein:

said second mass provides to the composition at least about 45 mM/l of total zirconium and titanium atoms and at least about 50 mole percent of the total is zirconium;

there is a molar ratio of fluorine atoms to the total of zirconium and titanium atoms that is at least about 6.15:1.00;

said fourth mass comprises a sufficient number of acidic moieties that the number ratio of acidic moieties to total carbon atoms is at least about 1.0:8.0;

the materials mixed to make the composition additionally include a fifth mass that provides to the composition at least about 6.0 mM/l of chelating agent molecules selected from the group consisting of molecules each of which contains at least two nucleophilic moieties selected from the group consisting of carboxyl, carboxylate, non-carboxyl hydroxyl, amino, thio, phosphonic acid, phosphonate, phosphinic acid, and phosphinate moieties, with these at least six-membered ring of atoms can be formed by atoms in the molecule and a multivalent metal atom that is coordinatively covalently bonded to a nucleophilic atom (oxygen, amino nitrogen, thio sulfur, or phosphinic phosphorus) in each of said nucleophilic moieties in the molecule.

15. A process of forming a substantially transparent conversion coating on a metal surface, said process comprising an operation of contacting said metal surface with an aqueous liquid composition, optionally after dilution with water, said liquid composition comprising water and the following components:

(A) a component of one or more dissolved transition; metal compounds that contains zirconium and may also include titanium, said component comprising at least about 0.25 mM/l of total zirconium and titanium atoms, provided: that zirconium constitutes more than 30% of the moles of the total moles of zirconium and titanium;

(B) a component of at least one dissolved compounds that, contains inorganically bonded fluorine and is not part of component (A), such that the molar ratio of fluorine atoms to the total of zirconium and titanium atoms is at least 6.05:1:00 and a fluoride sensitive electrode in contact with the composition has a potential that is from about −200 to about 100 mv when compared with the same fluoride sensitive electrode in contact with Standard Solution 120 MC; and (D) component of dissolved organic polymer molecules, wherein component (C) constitutes at least about 0.009 g/l of the composition and contains at least one of:

a sufficient number of acid moieties that the number ratio of acid moieties to total carbon atoms within component (C) is at least about 1.0:9.0; and a sufficient number of nucleophilic moieties that the number ratio of nucleophilic moieties to total carbon atoms within component (C) is at least about 1.0:50.

16. A process according to claim 15, wherein the aqueous liquid composition is maintained within a temperature range from 40 to 56° C. during said contacting with said metal surface.

17. A process according to claim 15, wherein said contacting is performed for a time of from 2 to 50 seconds.

18. A process according to claim 15, wherein said metal surface is comprised of aluminum.

19. A process according to claim 15, wherein said metal surface is a surface of an aluminum can.

* * * * *

UNITED STATES PATENT AND TRADEMARK OFFICE

CERTIFICATE OF CORRECTION

PATENT NO. : 6,558,480 B1
APPLICATION NO. : 09/807159
DATED : May 6, 2003
INVENTOR(S) : Rochfort et al.

It is certified that error appears in the above-identified patent and that said Letters Patent is hereby corrected as shown below:

Title page, (73) Assignee, delete "Gulp" and insert therefor --Gulph--.

Title page, second column, Assistant Examiner, delete "Ottmans" and insert therefor --Oltmans--.

Column 20, line 11, delete "Inorganically" and insert therefor --inorganically--.

Column 21, line 28, delete "propyfene" and insert therefor --propylene--.

Column 28, line 38, delete ":" and insert therefor --;--.

Column 28, line 56, delete "consisting" and insert therefor --consisting of--.

Column 31, line 22, after "least" insert --two moieties being bonded into the molecule in positions such that a five– or--.

Column 31, line 34, delete ";".

Column 32, line 3, delete ":".

Column 32, line 5, delete "compounds" and insert therefor --compound--.

Column 32, line 15, delete "(D)" and insert therefor --(C) a--.

Signed and Sealed this

Twenty-fourth Day of October, 2006

JON W. DUDAS
*Director of the United States Patent and Trademark Office*